US005813930A

United States Patent [19]

Strauther

[11] Patent Number: 5,813,930

[45] Date of Patent: Sep. 29, 1998

[54] BASKETBALL HOOP AND BACKBOARD COVER AND SYSTEM

[76] Inventor: Aaqil Strauther, 4441 Belcher Ct., Columbus, Ohio 43224-5307

[21] Appl. No.: 807,802

[22] Filed: Feb. 26, 1997

[51] Int. Cl.[6] ..... A36B 63/08

[52] U.S. Cl. ..... 473/485; 150/154; 206/315.1

[58] Field of Search ..... 473/476, 479, 473/480, 481, 482, 483, 484, 485, 486, 487, 488, 489, 504; 206/315.1; 150/154, 900

[56] References Cited

U.S. PATENT DOCUMENTS

| | | | |
|---|---|---|---|
| 4,082,269 | 4/1978 | Hill . | |
| 4,151,989 | 5/1979 | Dittrich . | |
| 4,244,569 | 1/1981 | Wong . | |
| 4,811,767 | 3/1989 | Kessler | 150/154 |
| 4,826,162 | 5/1989 | Allen | 206/315.1 |
| 4,954,384 | 9/1990 | Hartwell | 150/154 |
| 4,991,837 | 2/1991 | Deal . | |
| 5,192,092 | 3/1993 | DiBenedetto | 150/154 |
| 5,195,742 | 3/1993 | Bailey . | |
| 5,346,207 | 9/1994 | Heinen . | |
| 5,360,208 | 11/1994 | Fang . | |
| 5,433,095 | 7/1995 | Mitchell et al. . | |
| 5,480,139 | 1/1996 | Owen, Jr. et al. . | |
| 5,607,149 | 3/1997 | Van Nimwegen et al. | 473/479 |
| 5,628,507 | 5/1997 | Johnson | 473/479 |

*Primary Examiner*—Steven B. Wong
*Attorney, Agent, or Firm*—Porter, Wright, Morris & Arthur

[57] ABSTRACT

A basketball hoop and backboard covering system for covering a backboard and a basketball hoop, comprising a lower toroid ring removably attached to the basketball hoop, an upper toroid ring, connecting tubes attached between the lower toroid ring and the upper toroid ring, for suspending the upper toroid ring above the lower toroid ring, and a cover, wherein the cover is draped over the backboard and the upper toroid ring, and placed around the lower toroid ring, the basketball hoop and the bottom edge of the backboard. The cover is secured to the back side of the backboard. The cover is shaped to fit snugly around the backboard and the basketball hoop.

19 Claims, 8 Drawing Sheets

BASKETBALL HOOP AND BACKBOARD COVER AND SYSTEM

This invention relates to a basketball hoop cover, and more particularly to a water-resistant cover for the basketball hoop, the net attached to the hoop, and the backboard.

BACKGROUND OF THE INVENTION

The game of basketball is universally known and played. Persons of all ages and abilities enjoy the challenge of shooting basketballs through an elevated basketball hoop.

Because of its popularity in the United States and around the world, basketball hoop and backboards are commonly found outdoors in parks, on playgrounds, attached to garage doors and walls at the end of driveways, and numerous other places were basketball may be played. Because these basketball hoops are exposed to the elements, the basketball hoop and the mounting brackets attaching the basketball hoop to the backboard may rust, shortenting the useful life of the basketball hoop. Further, a rusting basketball hoop is unsightly and could be dangerous to those playing basketball. Also, the weather may rot out or otherwise cause the backboard to deteriorate. This will also affect the replay of the basketball and will adversely affect the use of the backboard. Further, the basketball net attached to the hoop is also adversely affected by prolonged exposure to the weather, and in time will tend to discolored and will eventually rot away.

Although it is well known that the weather and other outdoor element have an adverse effect on the basketball hoop and the backboard, most owners of the outdoor basketball hoops leave the hoops unprotected throughout the year. This includes during the winter months when the basketball hoop is not in use.

One of the objects of the instant invention is to provide a protective covering for the basketball hoop, the net, the mounting brackets, and the backboard.

It is also an object of the invention to provide a basketball hoop cover that is easy to install, so that the cover will be used on a regular basis.

Another object of the invention is to provide a basketball hoop cover that is inexpensive to manufacture and, therefore, readily affordable to the average consumer.

SUMMARY OF THE INVENTION

The present invention is directed to providing protection from inclement weather for the basketball hoop, the net attached to the basketball hoop, the mounting brackets, and for the backboard. This protection will extend the useful life of the basketball hoop and prevent rusting of the hoop and mounting brackets, as well as prevent the unsightly discoloration to the net.

In an illustrative embodiment of the invention, the basketball hoop and backboard cover and system comprise a cover that is suspended above the basketball hoop by a supporting system comprising: (1) a first toroid ring that is removably attached to the basketball hoop; (2) a second toroid ring; and (3) connecting tubes for suspending the second toroid ring above and angle down towards the first toroid ring. The cover is made from any suitable water-resistant material, for example a vinyl or plastic material. The basketball hoop cover is shaped loosely so that it may cover the basketball hoop, net and backboard. The cover is gathered behind the backboard by, for example, a draw string or by elastic means, so that the cover remains attached over the backboard. The cover may also be releaseably fastened to the backboard by any suitable attaching means, for example, a hook or Velcro® means.

BRIEF DESCRIPTION OF THE DRAWINGS

The foregoing and other features of the present invention will be more readily apparent from the following detailed description and drawings of exemplary embodiments of the invention in which.

DETAILED DESCRIPTION OF EXEMPLARY EMBODIMENTS

Figure 1:
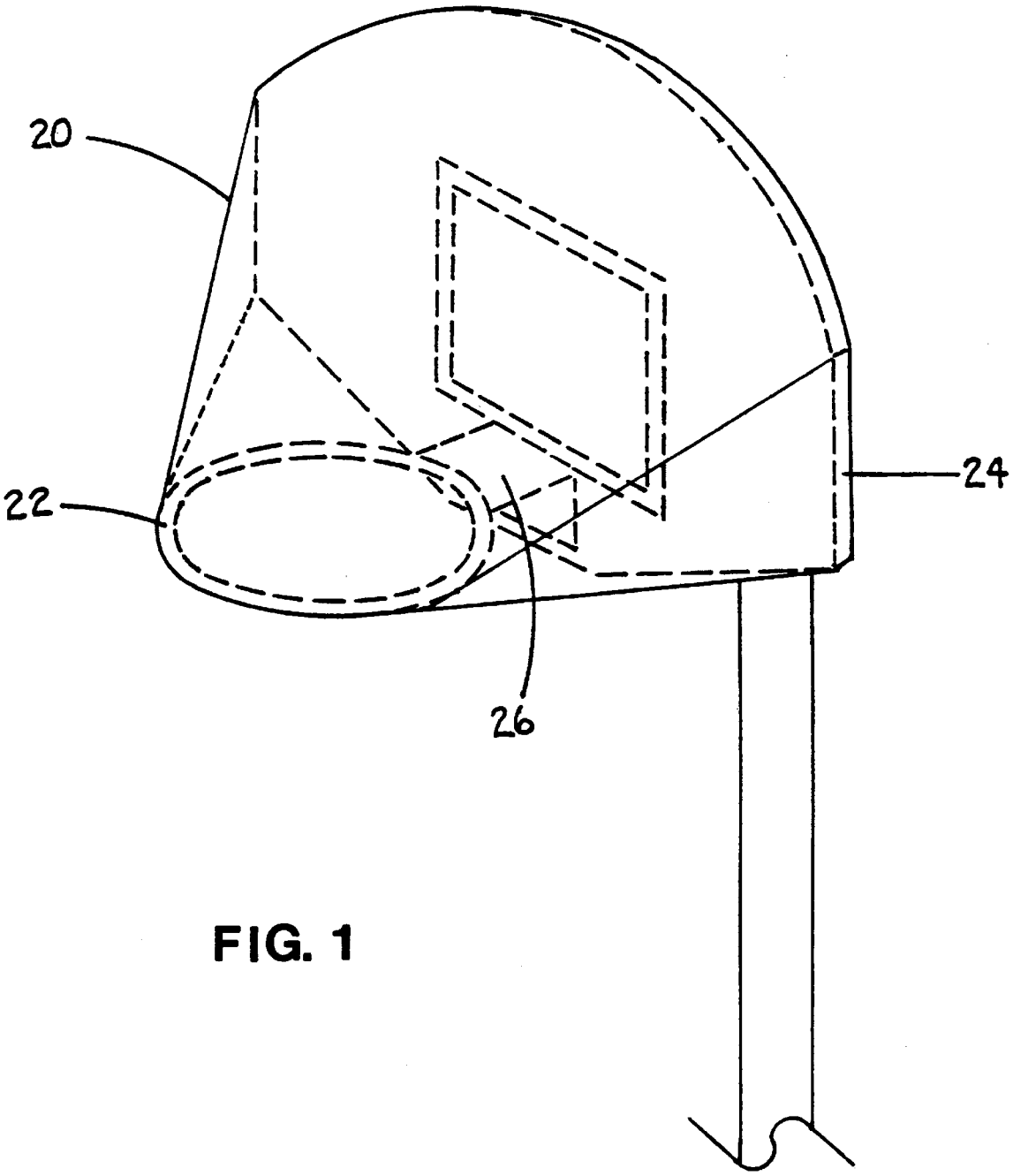
FIG. 1 is a perspective view of the invention, illustrating the basketball hoop and backboard cover as used to cover the backboard.

FIG. 1 is a prospective view of the instant invention, a basketball hoop, net and backboard cover. As illustrated in FIG. 1, the cover 20 is draped over the backboard 24 and around the basketball hoop 22. The lower portion of the cover 20 is then securely placed around the net and around the base of the backboard 24. The cover 20 is then secured about the back side of the backboard 24 by any suitable securing means. For example, a drawstring may be used to pull the ends of the cover 20 together. The drawstring is then tied together, thereby securing the cover 20 about the backboard 24. Any suitable fastening means may also be employed. For example, a hook and eye configuration may be used, whereby either the hook or eye is attached to the ends of the cover 20. If the hook is attached to the cover 20, then the eye is correspondingly attached to the backboard 24, for receiving the hook and securing the cover 20 to the backboard 24. Other fastening means such as Velcro® or snaps may be used.

The actual shape of the cover 20 may vary from a hood and skirt configuration to a sock configuration. A preferred construction employs the hood and skirt configuration whereby the hood is draped over the top edge of the backboard 24, and the skirt is gathered around the basketball hoop 22 and the bottom edge of the backboard 24.

The basketball hoop and backboard cover is preferably made from a suitable water-resistant material, for example, a vinyl or other plastic material.

As a practical matter, the basketball hoop cover would most often be used in the winter months, through periods of inclement weather, where it is expected that the cover would not be removed for extended periods of time. It is therefore important to provide a mechanism to allow snow and other deposits to run or slide off the cover. In a preferred embodiment of the instant invention, as illustrated in FIGS. 2–5, the cover 20 is suspended above the basketball hoop 22 by an arrangement of toroid rings, thereby allowing any deposits to slide off the cover.

Figure 2:
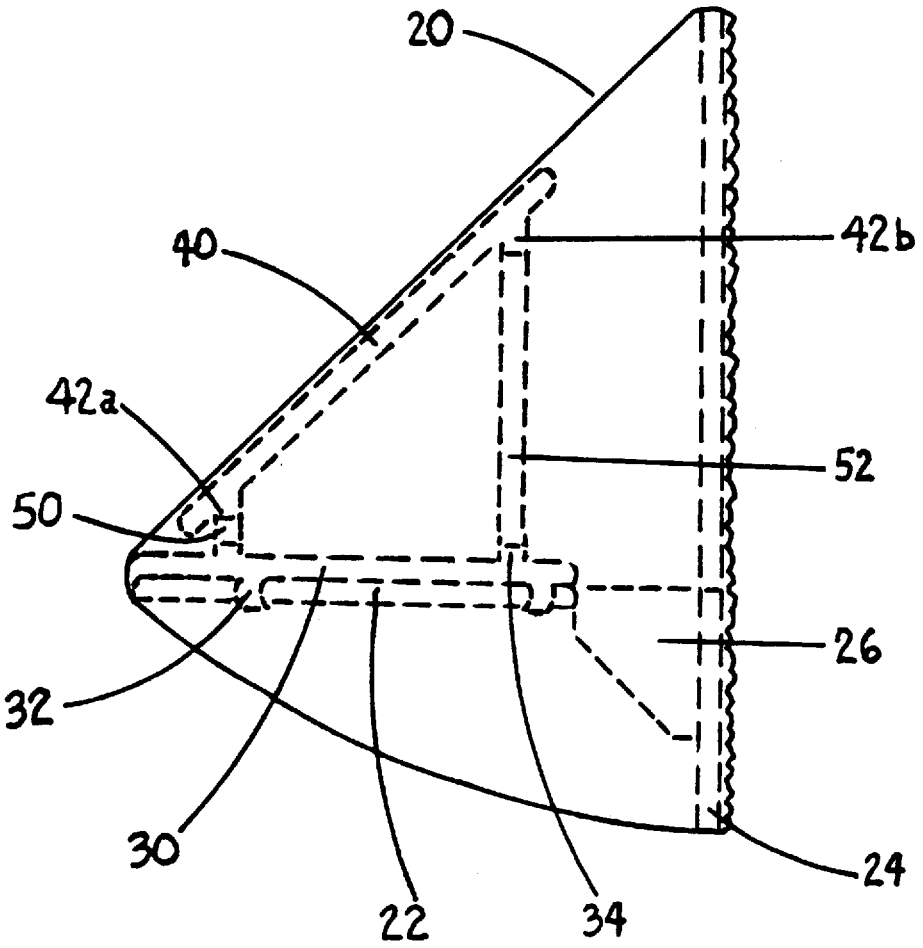
FIG. 2 is a side elevation view of a preferred embodiment of the invention, showing, in phantom, the supporting structure underneath the cover.

Referring to FIG. 2, the cover 20 is suspended above the basketball hoop 22 by an arrangement of toroid rings 30 and 40. As shown in FIG. 2, a lower toroid ring 30, corresponding in size to the basketball hoop 22, is placed securely onto the basketball hoop 22. An upper toroid ring 40 is suspended above the lower toroid ring 30 by a front pair and a rear pair of supporting tubes 50 and 52, respectively. The front pair of supporting tubes 50 are shorter than the rear pair of supporting tubes 52, allowing the upper toroid ring 40 to slope downwards from back to front.

As shown in FIG. 2, the cover 20 drapes over the top of the backboard 24, over the upper toroid ring 40, around the lower toroid ring 30 and the basketball hoop 22, and up and around the bottom edge of the backboard 24. As shown if FIG. 2, the mounting plate 26 for attaching the hoop 22 to the backboard 24 is also covered by the cover 20. This protects the mounting plate from rusting from prolonged exposure to the weather elements.

Figure 3:
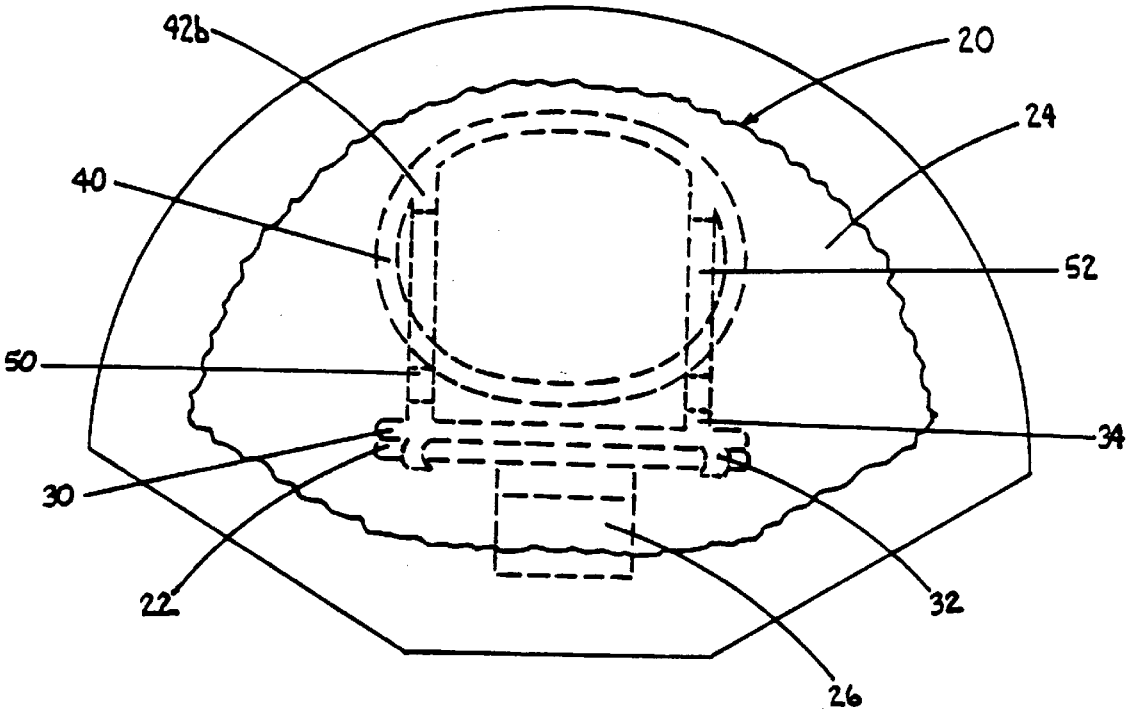
FIG. 3 is a back elevation view of the embodiment shown in FIG. 2, illustrating one means for attaching the cover to the backboard.
Figure 4:
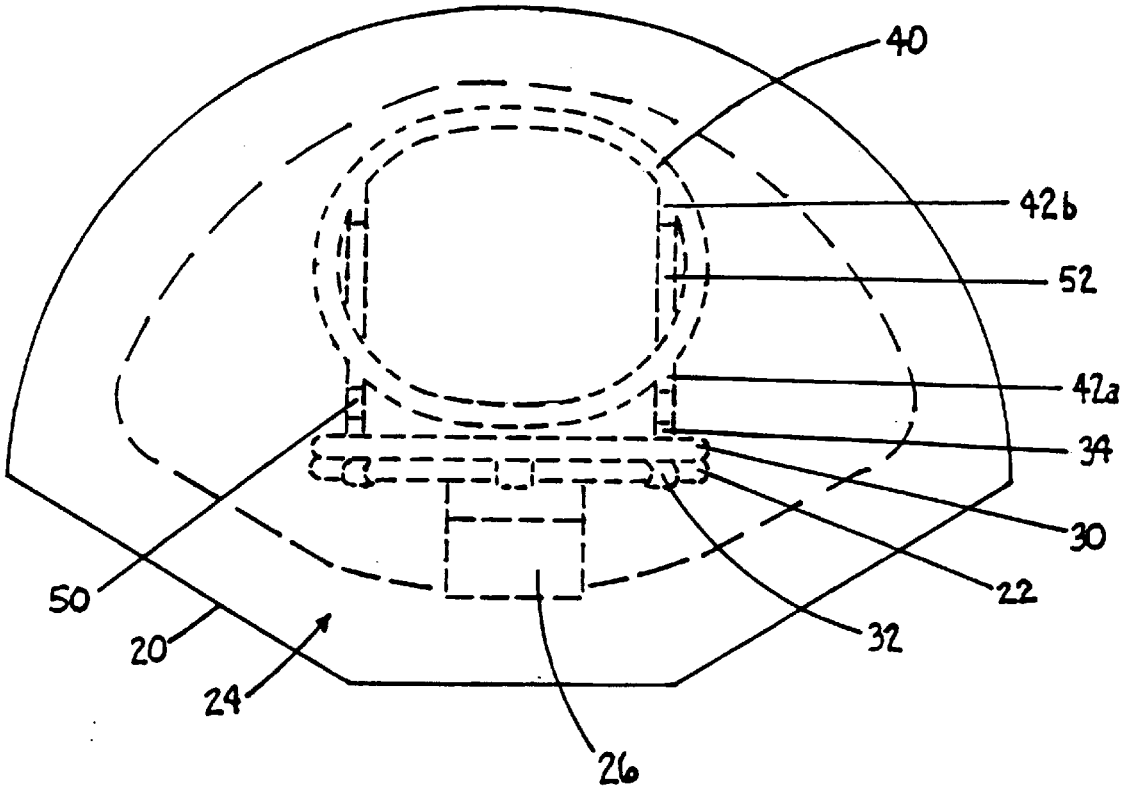
FIG. 4 is a front elevation view thereof, showing the cover completely surrounding the basketball hoop, net and backboard.
Figure 5:
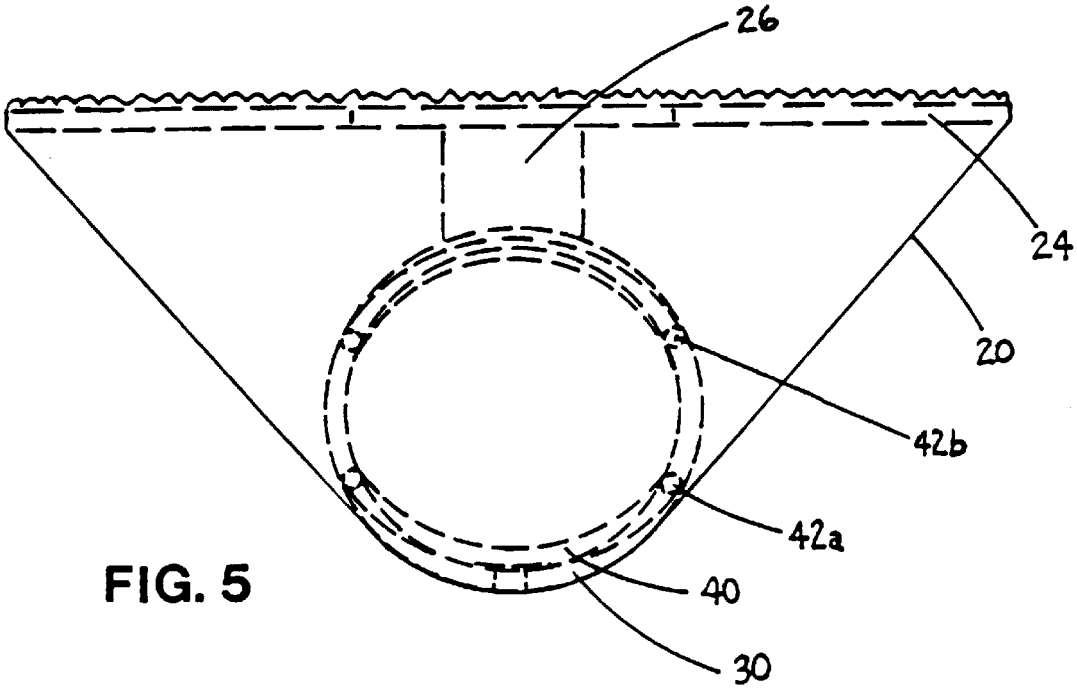
FIG. 5 is a top plan view thereof.

FIG. 3 illustrates the back side of the backboard 24 with the cover 20 securely fastened about the backboard 24. FIG. 4 is a front elevation view illustrating how the cover completely encloses the backboard 24 and the basketball hoop 22. FIG. 5 is a top plan view if the preferred embodiment of the invention, also showing the cover 20 completely surrounding the backboard 24, the basketball hoop 22 and the mounting plate 26.

Figure 6:
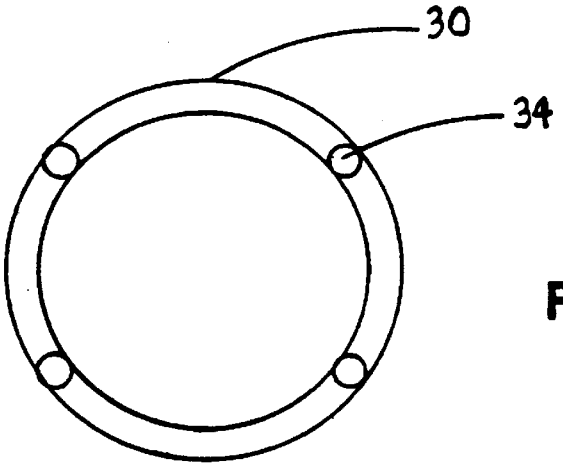
FIG. 6 is a top plan view of the bottom toroid ring used as part of the supporting structure of the invention.
Figure 7:
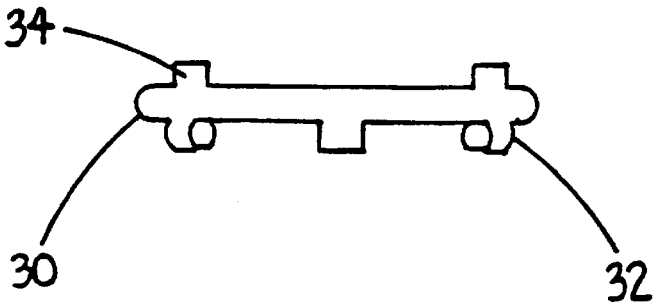
FIG. 7 is a front elevation view thereof.
Figure 8:
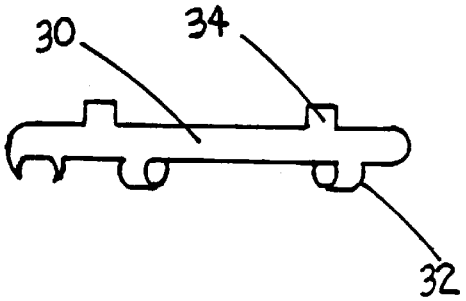
FIG. 8 is a side elevation view thereof.

The lower toroid ring 30, illustrated in FIGS. 6–8, has a top surface and a bottom surface, and is sized to correspond to the basketball hoop 22. A plurality of claw-like clasps 32 extends downwards from the bottom surface of the lower toroid ring 30.

These clasps 32 are used to secure the lower toroid ring 30 to the basketball hoop 22. The lower toroid ring 30 is placed above the basket ball hoop 22 and snapped down into place. On the top surface of the lower toroid ring 30 are two pairs of upwardly-extending sockets 34 for receiving the front and rear pairs of connecting tubes 50 and 52, respectively.

Figure 9:
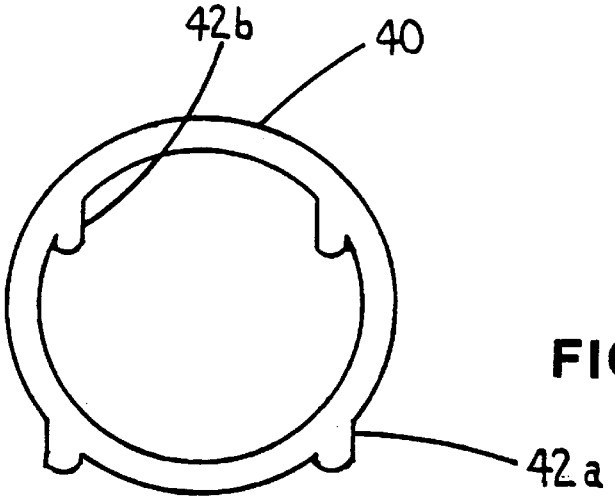
FIG. 9 is a top plan view of the top toroid ring used as part of the supporting structure of the invention.
Figure 10:
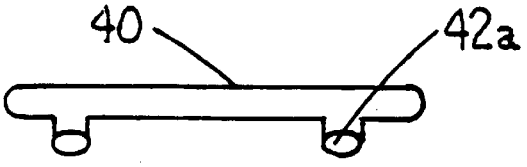
FIG. 10 is a front elevation view thereof.
Figure 11:
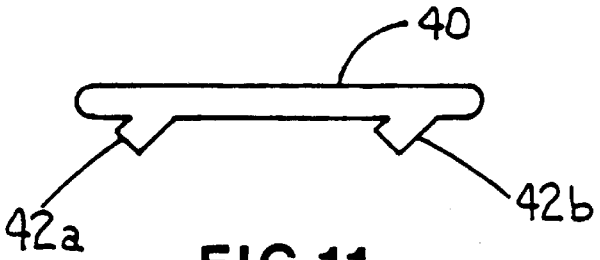
FIG. 11 is a side elevation view thereof.

FIGS. 9–11 illustrate the upper toroid ring 40. As shown in FIG. 11, the upper toroid ring 40 has two pairs of downward-extending sockets 42 that are angled in a forward direction with respect to the plane of the upper toroid ring 40. The downward-extending sockets 42 correspond to the upwardly-projecting sockets 34 of the lower toroid ring 30, and also receive the connecting tubes 50 and 52.

FIGS. 12 and 13 illustrate the front and rear connecting tubes 50 and 52, respectively. The front connecting tubes 50, shown in FIG. 12 are inserted into the front pair of upwardly-projecting sockets 34 and the front pair of downward-extending sockets 42. Similarly, the rear connecting tubes 52, shown in FIG. 13 are inserted into the back pair of upwardly-projecting sockets 34 and the back pair of downward-extending sockets 42. The back connecting tubes 52 are longer than the front connecting tubes 50, thereby causing the upper toroid ring 40 to slope downwards from back to front. This slope allows rain, snow and other debris to slide off the cover 20, once the covering system is assembled.

Figure 12A:
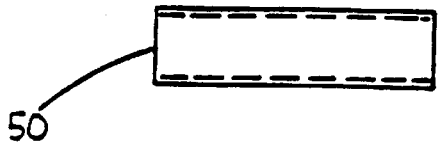
FIGS. 12*a* and 12*b* are side elevation and cross-section views, respectively, of the front connecting tube used as part of the supporting structure of the invention.
Figure 12B:
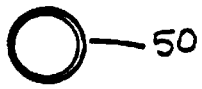
Figure 13A:
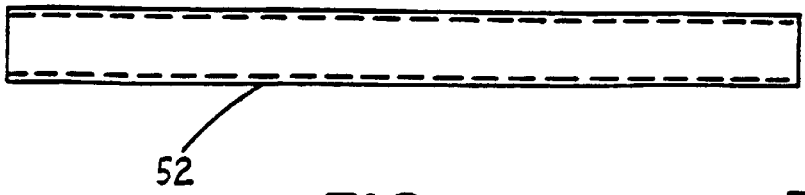
FIGS. 13*a* and 13*b* are side elevation and cross-section views, respectively, of the back connecting tube used as part of the supporting structure of the invention.
Figure 13B:
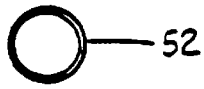

FIGS. 12*b* and 13*b* are cross-sectional views of the front and back connecting tubes illustrated in FIGS. 12*a* and 13*a*. As shown, the connecting tubes are preferably hollow, in order to reduce the overall weight of the toroid ring/connecting tube assembly.

For ease of manufacture, the toroid rings 30 and 40 and the connecting tubes may all be constructed out of the same material. Preferably, a suitable lightweight, durable material is used. For example, a plastic, rubber, synthetic fiber, or lightweight metal like aluminum, may be used. Also, in order to facilitate construction, it is preferably to make the upper toroid ring 40 the same size as the lower toroid rings 30.

Figure 14:
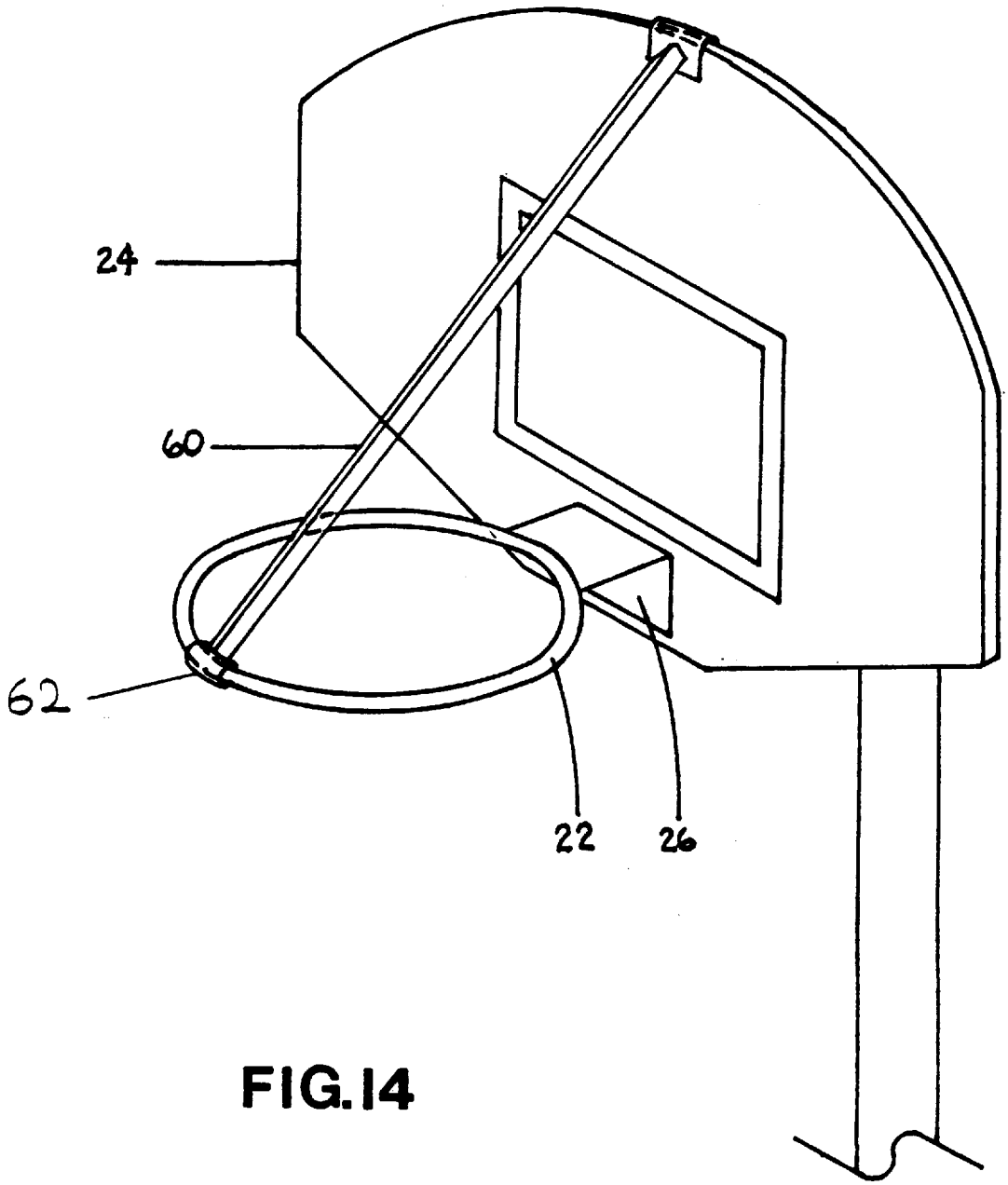
FIG. 14 is a perspective view of an alternative embodiment of the invention, illustrating a ledge for suspending the cover above teh basketball hoop.

Although a system of toroid rings are disclosed to elevate the cover 20 above the basketball hoop 22, any other suitable means may be used. For example, in an alternative embodiment, as illustrated in FIG. 14, a single ledge 60 is attached from the top edge of the backboard 24 to the front lip of the basketball hoop 22. Although FIG. 14 illustrates a flat hook 62 at each end of the ledge 60, for attaching the ledge 60 to the backboard 24 and the basketball hoop 22, any suitable attachment means can be used. The cover 20 is then draped over the ledge 60 so that the cover is suspended over the basketball hoop 22. Because the center of the cover 20 is elevated above the sides of the cover 20 by the ledge 60, rain, snow and other debris can readily slide off the cover 20.

Depending on the arrangement and size of the backboard, the distance between the top edge of the backboard 24 and the front lip of the basketball hoop 22 may vary. Therefore, it is envisioned as part of the instant invention that a collapsible ledge may also be used, so that the length of the ledge may be adjusted as required. This allows a single ledge to be used on a variety of basketball hoop/backboard configurations.

While the invention has been particularly shown and described with reference to preferred embodiments thereof, it will be understood by those skilled in the art that various changes in form and details may be made therein without departing from the spirit and scope of the invention.

I claim:

1. A basketball hoop and backboard cover for covering a basketball hoop when it is attached to a backboard, comprising:

a cover having a hood portion and a skirt portion;

means for suspending the cover above the basketball hoop, wherein the hood portion of the cover is draped over the backboard and the skirt portion is placed around the basketball hoop, and wherein the hood and skirt portions are secured at the back side of the backboard.

2. The basketball hoop and backboard cover as in claim 1, wherein the cover is made from a suitable water resistant material.

3. The basketball hoop and backboard cover as in claim 1, wherein the hood and lower portions of the cover are secured to the back side of the backboard by way of a drawstring.

4. The basketball hoop and backboard cover as in claim 1, further comprising:

attachment means fixedly attached to the backside of the backboard; and corresponding attachment means fixedly attached to the hood and lower portions of the cover for securing the cover to the backside of the backboard.

5. The basketball hoop and backboard cover as in claim 4, wherein the attachment means and corresponding attachment means comprise a hook and eye arrangement for securing the cover to the backside of the backboard.

6. The basketball hoop and backboard cover as in claim 4, wherein the attachment means and corresponding attachment means comprise mating Velcro® strips for securing the cover to the backside of the backboard.

7. A basketball hoop and backboard covering system, for covering a backboard having a top edge and a bottom edge, and a basketball hoop, comprising:

a lower toroid ring removably attached to the basketball hoop;

an upper toroid ring;

connecting tubes attached between the lower toroid ring and the upper toroid ring, for suspending the upper toroid ring above the lower toroid ring; and a cover having a hood portion and a skirt portion, wherein the hood portion of the cover is draped over the backboard and over the upper toroid ring, and wherein the skirt portion of the cover is placed about the lower toroid ring, the basketball hoop and around the bottom edge of the backboard, and further wherein the cover is secured to the backboard.

8. The basketball hoop and backboard covering system as in claim 7, wherein the lower toroid ring has an upper and a lower surface, the lower surface having a plurality of claw-like clasps for securing the lower toroid ring onto the basketball hoop, and wherein the upper surface has a front pair and a rear pair of upward-projecting sockets.

9. The basketball hoop and backboard covering system as in claim 8, wherein the upper toroid ring has a front pair and a rear pair of downward-projecting sockets, the socket being oriented at a forward facing angle with respect to the plane of the upper toroid ring.

10. The basketball hoop and backboard covering system as in claim 9, further comprising a front pair and a back pair of connecting tubes, wherein the back pair of connecting tubes are longer than the front pair of connecting tubes.

11. The basketball hoop and backboard covering system as in claim 10, wherein the front pair of connecting tubes are inserted into the front pair of upward-projecting sockets and the front pair of downward extending sockets, and wherein the back pair of connecting tubes are inserted into the back pair of upward-projecting sockets and the back pair of downward-extending sockets, such that the upper toroid ring slopes downwards from back to front.

12. The basketball hoop and backboard cover as in claim 1, wherein the cover is made from a suitable water resistant material.

13. The basketball hoop and backboard covering system as in claim 7, wherein the upper and lower toroid rings and the connecting tubes are made from one of a plastic, rubber, synthetic fiber, and metal material.

14. The basketball hoop and backboard covering system as in claim 7, wherein the hood and lower portions of the cover are secured to the back side of the backboard by way of a drawstring.

15. The basketball hoop and backboard covering system as in claim 7, further comprising:

attachment means fixedly attached to the backside of the backboard; and corresponding attachment means fixedly attached to the hood and lower portions of the cover for securing the cover to the backside of the backboard.

16. The basketball hoop and backboard covering system as in claim 14, wherein the attachment means and corresponding attachment means comprise a hook and eye arrangement for securing the cover to the backside of the backboard.

17. The basketball hoop and backboard covering system as in claim 14, wherein the attachment means and corresponding attachment means comprise mating Velcro® strips for securing the cover to the backside of the backboard.

18. A basketball hoop and backboard covering system, for covering a backboard having a top edge and a bottom edge, and a basketball hoop, comprising:

a ledge extending between the top edge of the backboard and the front lip of the basketball hoop; and a cover having a hood portion and a lower portion, wherein the hood portion of the cover is draped over the backboard, and over the ledge, and wherein the lower portion of the cover is placed about the basketball hoop and around the lower edge of the backboard, and further wherein the cover is secured to the backboard.

19. The basketball hoop and backboard covering system as in claim 18, wherein the ledge is collapsable, allowing the length of the ledge to be varied.

* * * * *